US005240323A

United States Patent [19]

Haber et al.

[11] Patent Number: 5,240,323

[45] Date of Patent: Aug. 31, 1993

[54] PHARMACEUTICAL MIXING CONTAINER WITH EXTENDABLE AGITATOR BELLOWS

[75] Inventors: Terry M. Haber, Lake Forest; Clark B. Foster, Laguna Niguel; William H. Smedley, Lake Elsinore, all of Calif.

[73] Assignee: Habley Medical Technology Corporation, Laguna Hills, Calif.

[21] Appl. No.: 949,608

[22] Filed: Sep. 23, 1992

[51] Int. Cl.[5] ..... B01F 11/00

[52] U.S. Cl. ..... 366/130; 206/219; 206/221; 215/DIG. 8; 366/256; 366/275; 366/332; 366/347; 604/416; 604/903

[58] Field of Search ..... 366/129, 130, 255, 256, 366/257, 259, 260, 275, 332, 334, 342, 343, 347; 604/201, 228, 232, 416, 903; 206/219, 221; 215/228, 231, 247, DIG. 3, DIG. 8

[56] References Cited

U.S. PATENT DOCUMENTS

| | | | |
|---|---|---|---|
| 1,929,616 | 10/1933 | Vopata | 206/221 |
| 2,449,968 | 9/1948 | Smith | 604/416 |
| 2,842,126 | 7/1958 | Brown | 604/201 |
| 2,887,108 | 5/1959 | Kendall | 604/201 X |
| 2,922,419 | 1/1960 | Bednarz | 604/201 |
| 3,330,282 | 7/1967 | Visser et al. | 215/DIG. 8 X |
| 3,560,162 | 2/1971 | Mittleman | 366/256 X |
| 3,560,163 | 2/1971 | Mittleman | 366/256 X |
| 3,885,710 | 5/1975 | Cohen | 206/221 X |
| 4,445,895 | 5/1984 | Margulies | 604/201 X |
| 4,850,966 | 7/1989 | Grau et al. . | |
| 4,950,237 | 8/1990 | Henault et al. | 604/416 X |
| 5,137,528 | 8/1992 | Crose | 604/232 X |

*Primary Examiner*—Harvey C. Hornsby
*Assistant Examiner*—Charles Cooley
*Attorney, Agent, or Firm*—Townsend and Townsend Khourie and Crew

[57] ABSTRACT

A pharmaceutical mixing container for storing a liquid having at least two factions which tend to separate during storage. A housing has an inner volume and is closed at one end by a septum arrangement. An extendable mixing element is slidably and sealingly positioned within the inner volume, the mixing element including a base member having a longitudinally extending through bore, a flexible bellows element secured to the base member and an actuating rod slidingly received within the through bore and coupled to the central portion of the bellows element. The bellows element is an axially symmetric member having convoluted concentric wall portions, and the actuating rod is coupled to the central region of the bellows element. By manipulating the actuating rod in opposite directions, the bellow is alternately extended and retracted to create general gentle agitation for any liquid and miscible component contained within the housing.

6 Claims, 2 Drawing Sheets

PHARMACEUTICAL MIXING CONTAINER WITH EXTENDABLE AGITATOR BELLOWS

BACKGROUND OF THE INVENTION

This invention relates to containers for liquids having a miscible component. More particularly, this invention relates to mixing containers for storing a liquid pharmaceutical.

Containers are known for storing a pharmaceutical having a liquid component and a second component miscible with a liquid component. A typical container of this type is filled with the pharmaceutical and stored for later use. Some pharmaceuticals separate into their individual components when left in storage. For example, liquid NPH insulin has a crystalline faction which must be in solution in order to be effectively administered. During storage in a container, such crystals precipitate out of the liquid solution and must be thoroughly mixed with the liquid faction just prior to administration. Admixture of the crystalline faction and the liquid faction has been achieved in the past in a number of different ways. One such technique is to provide a mixing element which is freely moveable within the container, in a similar manner to the mixing ball found in ordinary aerosol spray cans. This solution has been found to be less than desirable, since the crystalline faction is composed of delicate crystals which should not be mechanically damaged or ruptured during the mixing process. The use of a freely moveable mixing element within the container, however, has been found to damage and rupture the crystals, which severely impairs the effectiveness of the pharmaceutical. Efforts in the past to provide a pharmaceutical mixing container devoid of the above disadvantage have not been successful to date.

SUMMARY OF THE INVENTION

The invention comprises a pharmaceutical mixing container which provides thorough admixing of separated components in a pharmaceutical without mechanically damaging those components.

A pharmaceutical mixing container for storing a liquid having at least two miscible components includes a housing having a first end, a second end and a wall structure defining an inner volume, the housing preferably having cylindrical geometry. A closure member providing a fluid seal is arranged at the first end of the housing, the closure member preferably including a septum and a retaining band for securing the septum to the first end of the housing. An extendable mixing element is slidably and sealingly positioned within the inner volume of the housing, the mixing element including a base member having a longitudinally extending through bore, preferably arranged centrally thereof, a flexible bellows element secured to the base member, and means slidably received within the through bore and coupled to the bellows element for enabling extension and retraction thereof within the inner volume. The bellows element preferably comprises a cylindrical member having convoluted concentric wall portions. The means for enabling manual extension of the bellows element preferably comprises an actuating rod slidably received within the base member through bore and coupled to the central portion of the flexible bellows element. In the preferred embodiment, the housing is cylindrical and the bellows element is symmetric about the longitudinal axis of the cylinder as installed therein.

In use, the liquid is stored within the container and is admixed prior to administration by manipulating the actuation rod inwardly of the housing to extend the bellows element into the inner volume. Extension of the bellows element causes a gentle agitation to the liquid and other constituents located in the inner volume. The bellows is then retracted by withdrawing the actuating rod, and this reciprocal motion can be repeated until the pharmaceutical constituents are thoroughly admixed. Since the amount of agitation is directly controlled by the user, mechanical damage to the constituents being admixed is minimized or eliminated by operating the actuating rod at a gentle pace.

The liquid may be hydraulically withdrawn from the inner volume of the housing by penetrating the septum with a needle cannula of a syringe and subsequently operating the syringe. The liquid may also be expelled from the inner volume of the housing by penetrating the septum with a double point needle and forcibly ejecting the liquid using the base member to translate the bellows in the direction of the septum end of the housing.

While the invention may be employed with a wide variety of miscible pharmaceutical components, it is ideally suited for use with pharmaceuticals having a liquid faction and a crystalline faction requiring admixture prior to use. In particular, the manually controllable gentle agitation afforded by the extendable bellows element is sufficient to thoroughly admix the constituents without damaging the crystal structure.

For a fuller understanding of the nature and advantages of the invention, reference should be had to the ensuing detailed description taken in conjunction with the accompanying drawings.

DESCRIPTION OF THE PREFERRED EMBODIMENTS

Figure 1:
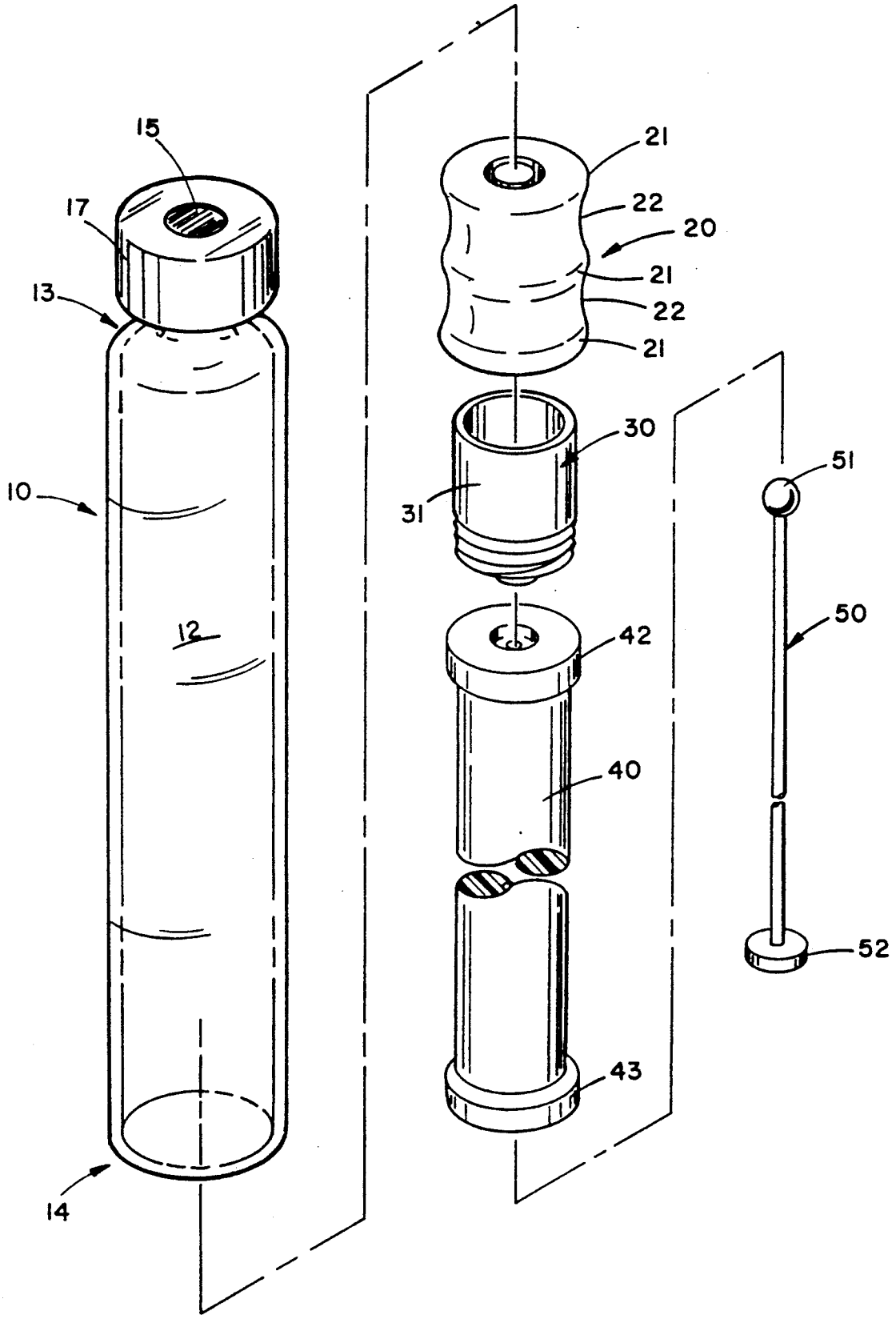
FIG. 1 is an exploded perspective view showing the preferred embodiment of the invention.

Turning now to the drawings, FIG. 1 illustrates a preferred embodiment of the invention. As seen in this Fig., a housing generally designated with reference numeral 10 has a generally cylindrical geometrical configuration defining an inner volume 12, a distal end 13 and a proximal end 14. Housing 10 may be fabricated from glass or any suitable plastic material which is compatible with the pharmaceutical to be contained therewithin. Secured to distal end 13 is a closure member comprising an elastomeric septum 15 which is retained to distal end 13 by means of a metal band 17. Septum 15 and band 17 are fabricated and arranged in such a manner that access to the inner volume 12 may be gained by penetrating the band 17 and septum 15 with a needle-like probe, such as a needle cannula of a syringe or a double point syringe needle.

Figure 2:
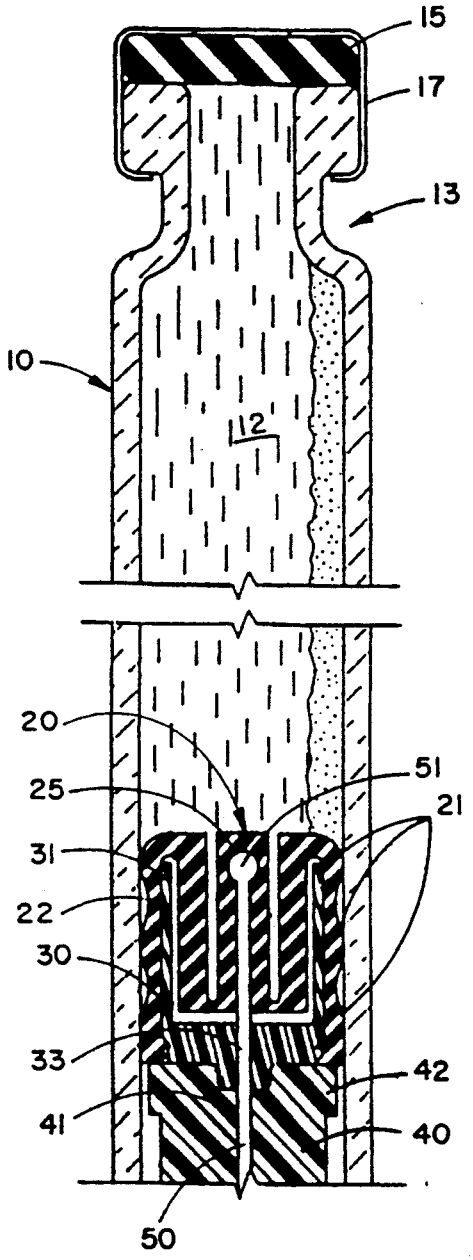
FIG. 2 is a sectional view of the assembled device showing the upper portion of the housing with the bellows element in the retracted position.
Figure 3:
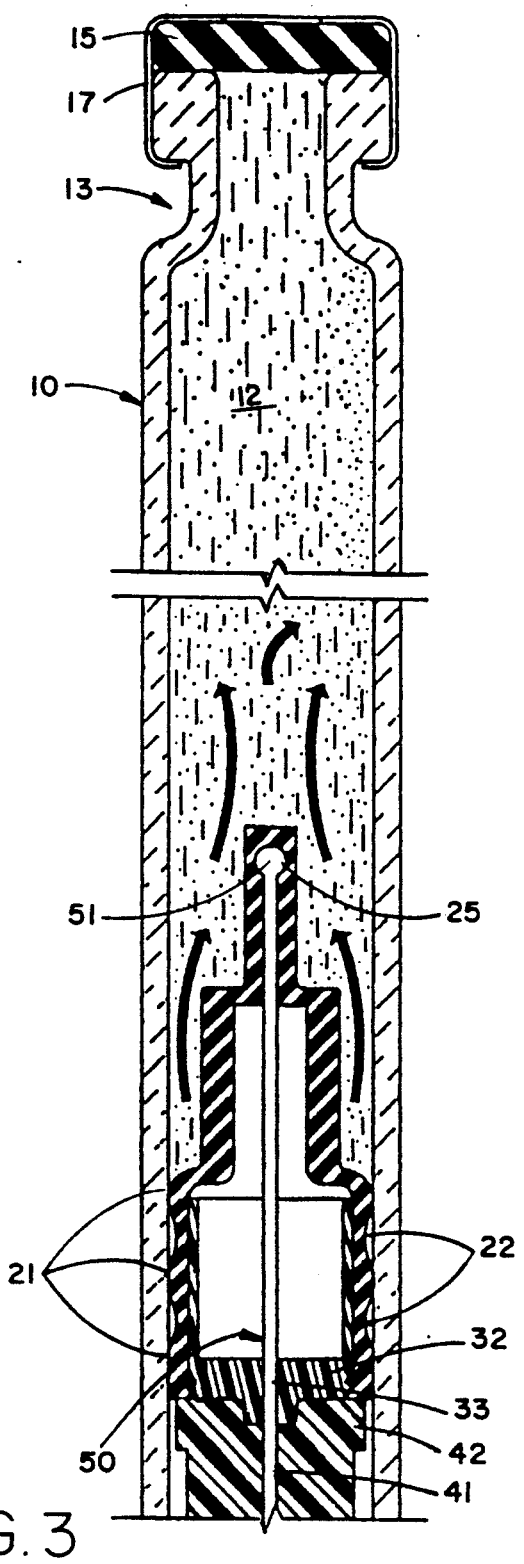
FIG. 3 is a sectional view similar to FIG. 2 showing the bellows element in the extended position.

An extendable mixing element is positioned at least partially within the housing 10 and includes a flexible bellows element generally designated with reference numeral 20. Bellows element 20 is provided with crests 21 and troughs 22 along the outer surface in order to provide a fluid seal with the inner wall surface of housing 10. Bellows element 21 preferably has axial symmetry about the rotational axis thereof, which is preferably coincident with the longitudinal axis of the housing 10. As best shown in FIGS. 2 and 3, bellows element 20 has convoluted concentric wall portions when in the folded position shown in FIG. 2 and is extendable to a position illustrated in FIG. 3 in which the wall portions are unfolded to their maximum extent and extend inwardly into inner volume 12 of housing 10.

Bellows element 20 is secured to a relatively inflexible support member 30 having upstanding side walls 31 and a closed bottom portion 32 with a central through bore 33. Support member 30 is secured to a base member 40 having a central through bore 41 and enlarged upper and lower end portions 42, 43.

Slidably received within central through bores 33 and 41 is an actuator rod 50 having an enlarged driving end 51, preferably formed in the shape of a ball, and a base portion 52 of enlarged diameter. As best shown in FIGS. 2 and 3, driving end 51 is received within a recess 25 formed centrally on the inner side of the bellows element.

To assemble the device, support member 30 is secured to base member 40 in any suitable fashion, e.g., bonding, adhesion, or the equivalent, the driving end of actuator rod 50 is fitted into recess 25 in bellows element 20, after which actuator rod 50, with lower base portion 52 removed, is maneuvered downwardly through through bores 33 and 41. Thereafter, enlarged base portion 52 is attached to the lower end of the actuator rod 50, and bellows element 21 is secured to member 30 in any suitable fashion, such as the friction fit illustrated in the Figs. Thereafter, bellows element 20 is maneuvered into the interior of housing 10 to the desired axial position. The inner volume 12 is then filled with the pharmaceutical liquid, and septum 15 and closure band 17 are installed to seal volume 12.

When the pharmaceutical is to be administered, the actuator rod 50 is manipulated by the user to extend bellows element 20 in the direction of distal end 13 as shown in FIG. 3, followed by retraction of the bellows element 20 to the folded position illustrated in FIG. 2. By repeated reciprocation of bellows element 20, gentle agitation is afforded for the pharmaceutical constituents within inner volume 12 so as to thoroughly admix these ingredients. It should be noted that, during extension of the bellows element 20, the entire assembly is forced downwardly as viewed in the Figs. due to the displacement of fluid by the extension of bellows element 20. The agitation flow when the bellows element 20 is extended into the inner volume is suggested by the flow arrows depicted in FIG. 3.

After thorough admixture, the liquid pharmaceutical can be administered in one of two ways. In a first procedure, the septum 15 is penetrated by means of a needle cannula of a syringe and the liquid is withdrawn from inner volume 12. In a second procedure, the septum is penetrated by a double point needle, and base rod 40 is driven upwardly as viewed in the Figs. to move the collapsed bellows element 20 toward the septum end of housing 10 and forcibly expel the liquid.

Bellows element 20 may be fabricated from any suitable inert and non-toxic flexible material, such as butyl rubber or silicone rubber. Members 30, 40 and 50 can be fabricated from any suitable inert material, such as polystyrene, polypropylene or the equivalent.

As will now be apparent, containers fabricated according to the invention are capable of providing thorough admixture of the pharmaceutical constituent ingredients in a relatively simple and expedient fashion. In addition, containers fabricated according to the invention are relatively simple and inexpensive to manufacture, can be readily filled with the appropriate liquid pharmaceutical, and can easily be employed for administering the pharmaceutical to a patient.

While the above provides a full and complete disclosure of the preferred embodiments of the invention, various modifications, alternate constructions and equivalents may occur to those skilled in the art. Therefore, the above descriptions should not be construed as limiting the scope of the invention, which is defined by the appended claims.

What is claimed is:

1. A pharmaceutical mixing container for storing a liquid with a miscible component, said container comprising:

a housing having a first end, a second end and an internal wall structure defining an inner volume;

a closure member at said first end providing a fluid seal; and an extendable mixing element slidably and sealingly positioned within said inner volume, said mixing element including a base member having a longitudinally extending through bore, a flexible bellows element secured to said base member, said bellows element having a first portion with an outer wall in constant sealing engagement with said internal wall structure and a movable second portion received within said first portion when in a retracted position said second portion extending outwardly from said first portion and into said inner volume when in an extended position, and means received within said through bore and coupled to said bellows element for enabling manual extension of said bellows element into said extended position and said retracted position for creating gentle agitation for any liquid and miscible component contained within said housing.

2. The invention of claim 1 wherein said means for enabling manual extension is coupled to a central portion of said bellows element.

3. The invention of claim 1 wherein said bellows element comprises a substantially cylindrical member having convoluted concentric wall portions.

4. The invention of claim 1 wherein said closure member comprises a septum.

5. The invention of claim 4 wherein said closure member further includes a retaining band.

6. The invention of claim 1 wherein said housing has cylindrical geometry.

* * * * *